US005383666A

United States Patent [19]

Kaplan

[11] Patent Number: 5,383,666

[45] Date of Patent: Jan. 24, 1995

[54] DECAGON SHAPED BRIDGE BIDDER

[76] Inventor: Murray M. Kaplan, 1146 S. Doheny Dr., Los Angeles, Calif. 90035

[21] Appl. No.: 195,344

[22] Filed: Feb. 9, 1994

[51] Int. Cl.[6] ..... A63F 1/06

[52] U.S. Cl. ..... 273/148 R

[58] Field of Search ..... 273/148 R, 292, 150

[56] References Cited

U.S. PATENT DOCUMENTS

| | | | |
|---|---|---|---|
| 1,507,644 | 9/1924 | Wareing | 273/148 R |
| 1,653,440 | 12/1927 | Slayton | 273/148 R |
| 1,656,993 | 1/1928 | Searle | 273/148 R |
| 1,772,703 | 8/1930 | Burleigh | 273/148 R |
| 1,786,809 | 12/1930 | Wolyn | 273/148 R |
| 1,898,862 | 2/1933 | Walker | 273/148 R |
| 3,013,349 | 12/1961 | Cooper | 273/148 R |
| 3,420,526 | 1/1969 | Berger | 273/148 R |
| 4,073,493 | 2/1978 | Moreland | 273/148 R |
| 4,092,026 | 5/1978 | Barbier | 273/148 R |
| 4,190,253 | 2/1980 | Andrae | 273/148 R |

FOREIGN PATENT DOCUMENTS

| | | | |
|---|---|---|---|
| 2658732 | 8/1991 | France | 273/148 R |
| 216918 | 7/1986 | United Kingdom | 273/148 R |

*Primary Examiner*—William E. Stoll

[57] ABSTRACT

A single table top, hand operated bridge card game bidding device which all 4 players use sequentially to silently communicate their bids. These bids are selected from bid cards (20) of ten different bid categories. These bid categories are permanently interlocked by a plastic binder comb (24) to a flat, ten equal sided vinyl base. (22). The binder comb also functions as a hinge on which the bid cards are turned back and forth between a ready to bid outer base position and a having been bid inner base position. The base and the bid cards have conforming, aligned spaced through holes (26) which match up with the two teeth (30) of the binder comb. This conformity and union effectuates a viable device.

1 Claim, 6 Drawing Sheets

DECAGON SHAPED BRIDGE BIDDER

BACKGROUND-FIELD OF INVENTION

This invention relates to a single, hand operated table top device used simultaneously and sequentially by all 4 contesting bridge card game players. It permits the contestants to visually communicate their individual bids by using custom designed bid cards instead of doing so vocally.

The purpose and usefulness of this visual device, while promoting speed and accuracy, is to prevent players from illegally conveying hidden, coded vocal bid messages to their partner(s) by voice modifications. Another purpose is to deny and eliminate the opportunity and practice of players to eavesdrop on the vocal bidding coming from adjacent tables during a multiple table contest such as duplicate bridge. These eavesdroppers know they will soon be playing those very same hands.

BACKGROUND-DESCRIPTION OF PRIOR ART

Two prior art discoveries appear not to be patented. They are Written Bidding and the Bidding Boxes TM.

The first, Written Bidding, is described in the Official Encyclopedia of Bridge, 3rd edition, 1976, page 578.

The encyclopedia is published by the American Contract Bridge League. Its 4th edition will be issued in 1994. In response to my telephone call, a league official reported that, except for Austrailia, this written bid system is not used anymore. I was also informed that the League has no copy or sample of the "dumb bidder" pad referred to in the encyclopedia or knowledge as to where such pad could be found. A second call to Baron Barclay Bridge Supplies, Louisville, Ky. resulted in the same response. Barclay has no information on the system or the pad. Barclay is probably one of the largest, if not the largest bridge supply company in the country. Barclay did bring to my attention its distribution of a silent bidding system, the BIDDING BOXES.

As indicated in the Barclay 93-94 catalog, the BIDDING BOXES are available in four models. There are two free standing table top models and two clamp on styles.

The free standing models are approximately:

(a) the Pocket Box: $2\frac{1}{2}$ cm×$7\frac{1}{2}$ cm×16 cm ($1''\times3''\times6\frac{1}{4}''$)

(b) the Portable Box: 13.3 cm×9 cm×5 cm ($5\frac{1}{2}''\times3\frac{1}{2}''\times2''$)

Each box contains 52 bid cards divided into two distinct sets of 35 and 17 cards each. The cards of both sets are of varying sizes and shapes. The 35 bid card set is sub-divided into five different categories. These categories are no trump, spades, hearts, diamonds, and clubs. These are still further divided into seven numerical bid levels from 1 to 7. The cards of the 35 set are approximately 6.5 cm ($2\frac{5}{8}''$) wide. Starting with the numerical seventh level bid card, which is approximately 7 cm (2.75") high, each subsequent level bid card to the first level, graduate in height by 1 cm, reaching an approximate 12.5 cm ($4\frac{5}{8}''$) at the one level bid card.

The second set of 17 bid cards consists of 6 pass, 4 double, 3 redouble, and one each of stop, alert, tournament director, and a no smoking card. This second set of bid cards measures approximately 6.5 cm ($2\frac{5}{8}''$) in width and 7 cm (2.75") in height.

THE BIDDING BOX Pocket Model has embossed on its bottom and inside of the box a 13 cm (0.5") circular four leaf clover design logo surrounded by printing which reads ©BIDDING BOX®.

Both sets of bid cards are loosely stacked in the plastic box. Each set is kept apart from the other.

The measure of success of any non-vocal bidding device must be its ability to faultlessly perform as fast or faster than does vocal bidding. It must not bring into being more problems than it solves. It must not inordinately slow up or delay the bidding process and the play of the game. Both the Written Bidding and BIDDING BOXES systems create material disadvantages which adversely affect the very game itself.

Problems with the Written Bidding (1) It squanders too much valuable game playing time.

(a) The time the opening bidder has to expend in putting down his 13 card bridge hand in order write out her/his bid. Then time to pass on the pad to his left.

(b) The total time this same process is repeated by each of the subsequent bids.

(c) The time each of the bidders consume in reading the bids and digesting the bids.

(2) It changes, not for the better, the technique and momentum of the present, universal bidding process. With vocal bidding, the other three players, upon hearing the bidder's announcement, can immediately evaluate it in relation to their individual hands. They can mentally prepare themselves for their responses and bids. This impossible with the Written Bidding system.

(3) Illegible handwriting is another consideration and negative factor in this system.

Problems with the BIDDING BOXES (1) Very few, if any, people are dextrous enough to hold their 13 bridge card hand in one hand while extracting a selected bid from the 35 card section with the other. With the 17 card section, one hand extraction is virtually impossible because these cards have no identifying tabs, are of varying shapes, and are loosely stacked in the box. Thus, each time a player makes a bid, he/she must lay down their 13 cards in order to have both hands free to use the BIDDING BOXES.

(2) Upon extraction, and following the instructions on how to use the BIDDING BOXES, each bidder must place the bids in front of himself/herself, from left to right, in an orderly and prescribed overlapping manner. This chore consumes valuable game playing time.

(3) Returning the extracted bid cards to the box is even more complicated and difficult because of their varying sizes and shapes. Further, the BIDDING BOXES instructions, while telling the players where and how to spread their extracted 35 set bid cards in front of themselves, provides no instruction(s) as to where the cards from the 17 bid section are to be placed. Yet this 17 bid card section includes three vital bids. These are pass, double, and redouble. These bids have to be integrated in their proper sequence of bidding with the 35 set of bid cards. They must be included in the overlapped, extracted bid cards spread out in front of each player. Otherwise the true sequence of the bidding is lost. Therefore, the "review" as claimed by the Barclay's advertisement(s) is not true. With the 17 section bid cards interspersed with the 35 bid cards, as they must be, the 35 section cards cannot be "simply pushed together and put back into the box." Valuable time and effort must be expended to first separate the cards of the two sections before they can be replaced into the box.

(4) These loose cards can be misfiled creating further delays.

(5) The bid cards of both sections stand freely and loosely in the box. Should that container be dropped or over-turned, the cards will be spilled out onto the table or the floor. Much valuable playing time would be lost restoring them to their proper position(s).

(6) Visibility is a problem in locating the desired bid card in both sections. The tabs which identify the 35 bid card section as to its category and numerical bid level are only approximately 7 cm (¼") in height. Locating the desired bid card from the 17 card section is even more difficult. Here, with no tabs, there is zero visibility. The varied shapes and loosely clustered arrangements of these cards makes it toilsome to find and extract a desired bid.

OBJECTS AND ADVANTAGES

Accordingly, besides the objects and advantages of the decagon shaped bridge bidder, described in the above patent, several objects and advantages of the present invention are:

(1) It provides a non-vocal, visual system, single bidding device per table of 4 players which bids as fast as does vocal bidding. This is accomplished by the device's unique ten equal sided base, unusual two sided bid cards, and a binder comb which interlocks the base with the bid cards. The binder comb also functions as a hinge on which the bid cards are turned.

(2) It provides a non-vocal bidding apparatus which requires the use of only one such device by all 4 players at the table.

(3) It provides a non-vocal bidding device which is exceptionally smaller than the total size of the compulsory set of 4 Bidding Boxes. One Decagon is exceptionally smaller than one unit of the Bidding Box set.

(a) The decagon shaped bridge bidder, in its carrying mode, is approximately 12 cm (4") wide and 12 mm (½") high.

(b) One Portable BIDDING BOX is approximately 13.3 cm×9 cm×5 cm (5½"×3½"×2"). This measurement must be multiplied by 4 in order to accomodate the compulsory 4 boxes needed at each table.

(4) It provides a non-vocal bidding device which is much lighter in weight that the BIDDING BOXES.

(a) A fully assembled decagon shaped bridge bidder weights approximately 2 ounces.

(b) One BIDDING BOX weighs approximately 6 ounces.

(c) A compulsory set of 4 BIDDING BOXES weighs 1½ pounds.

(5) It provides a non-vocal bidding device which is easily carried about either singly or in volume.

(a) One decagon shaped bridge bidder fits in the palm of one's hand.

(b) A decagon shaped bridge bidder can easily be carried in one's pocket or purse. See Drawing Sheet 2/6 FIG. 2.

(c) 42 decagon shaped bridge bidders, which can serve 168 players at a multiple table contest, can be stored and transported about in one shoe box approximately 17.8 cm (7") wide, 35.5 cm (14") long and 11.5 cm (4") deep. To serve the same 168 players, a social or duplicate bridge club would need 168 BIDDING BOXES in 14 similar sized shoe boxes.

(d) It takes a great amount of time and energy to carry 168 boxes to 42 tables, set out 4 to a table, and to later to retrieve and re-storage them. With only 42 palm-sized decagon shaped bridge bidders, all this work and effort can be done in a fraction of the time.

(e) 42 decagon shaped bridge bidders weigh approximately 5 pounds.

(f) 168 BIDDING BOXES weigh approximately 63 pounds.

(6) It provides a non-vocal bidding device which has a maximum card visibility and which offers the easiest access for extraction. The decagon shaped bridge bidder accomplishes by reason of its wide open design. Set in the center of the table and within finger tip reach of all the players, it is clearly visible. With all its bid cards turned to its ready to be bid outer position, as shown by my drawing sheet 3/6 FIG. 4, every bid card is precisely identified as to its category and where pertinent, its numerical bid level. This highly visible and legible identification is approximately 4 cm (1½") high. Please see my drawing sheet 5/6 FIGS. 7 and 8. This compares to the BIDDING BOXES 35 card set which has a small tab identifying each card of approximately 6 mm (¼") high and the 17 bid card set which has no identity tabs.

(7) It provides a non-vocal bidding device whose bid cards are of the same shape, size, and pattern. Such uniformity contributes to the pace and celerity of the bidding process. In contrast, the BIDDING BOX cards are a variegated assortment of shapes, sizes and patterns. This conglomeration does little to promote a rapid bidding process.

(8) It provides a non-vocal bidding device which has its unique means of locking its base and its bid cards into a secure permanent state. One which prevents spillage and forestalls mis-filing of cards. The decagon shaped bridge bidder accomplishes these objectives by its use of binder combs. This device's bid cards, able to pivot on the binder comb which also acts as a hinge, never leave the base or is their precise, orderly position altered. Unlike the decagon shaped bridge device, the BIDDING BOXES cards are loosely standing in their container. Should the box be overturned or dropped, its cards can fall out on to the table or the floor. Valuable game playing time must then be diverted to restoring them. This opens up the possibility of cards being misplaced when they are returned to the container. Again the possibility of wasted time to make up the correction when finally discovered.

(9) It provides a non-vocal bidding device which allows every bidder to continue holding his/her 13 card bridge hand in one hand while using the other to use the device. The unique design, elements, and construction of the decagon shaped bridge bidder achieves this. Unlike the BIDDING BOXES which forces a player to reach into the box to make an extraction and later reach back into the box to make a return, the decagon shaped bridge bidder's flat, wide open stance allows the player to finger-flip the cards from their to be bid outer position to their having been bid inner position. With one hand a player can turn a bid card as fast as she/he can verbalize the bid.

DRAWING FIGURES

In the drawings closely related figures have the same number but different alphabet suffixes. FIGS. 1 to 8 are the actual sizes. FIGS. 9A to 9E are 100% enlargements.

FIG. 1 shows an overhead view of the bare decagon shaped base with the location sites of its 20 spaced through holes.

FIG. 2 shows an overhead view of the base with all its cards in their overlapped having been bid inner position at the center point of the base.

FIG. 3 shows an eye level side view of the base, its bid cards in their having been bid inner position.

FIG. 4 shows an overhead view of the base with all its bid cards in their ready to be bid outer position.

FIG. 5 shows an eye level side view of the base with bid cards in their ready to be bid outer position.

FIG. 6 shows an overhead view of the base with bid cards in both their outer and inner positions.

FIG. 7 shows the two identical sides of those bid cards in the five categories which are each sub-divided into numerical bid levels. It also shows the location sites of the card's spaced through holes.

FIG. 8 shows the two identical sides of those bid cards of the five categories which are not further divided into numerical levels.

FIG. 9A shows a perspective view of the binder comb with its teeth overlapping the spine's exterior.

FIG. 9B shows a perspective view of the binder comb with its teeth inserted under the spine and into the interior of the comb.

FIG. 9C shows an eye level view of a partial edge of the perimeter of the base with inserted and attached binder comb. The binder comb's teeth overlap the spine's exterior.

FIG. 9D shows an eye level view of a partial edge of the perimeter of the base with inserted and attached binder comb. Its teeth are slightly raised up and way from the binder comb's exterior spine.

FIG. 9E shows an eye level view of a partial edge of the perimeter of the base with an inserted and attached binder comb. With its category bid cards now attached, the binder comb's teeth are now under and into the spine.

| Reference Numerals in Drawings | | | |
|---|---|---|---|
| 20 bid cards | 24 binder comb | 28 binder spine | 32 binder lip |
| 22 base | 26 through holes | 30 binder teeth | 34 base perimeter |

DESCRIPTION OF FIGURES

It is the simple straightness of any one of the ten equal 3.2 cm (1¼") wide outer perimeter edges of the decagon shaped bridge bidder which makes this device possible to construct and viable in its function. A straight side can accept and tolerate the attachment of a workable 3.2 cm binder comb. Such toleration permits the binder comb to act as a hinge between the base and the affixed bid cards. At the same time that it is interlocking the base and the affixed bid cards, it is just as importantly serving as a pivot which permits the mobile, turning back and forth movements of the bid cards.

The cards can be finger-flipped from outer to inner positions swiftly. This is a movement which functions fast enough to compete with the celerity of vocal bidding.

Drawing 1/6

Drawing 2/6 In FIG. 7, the illustrated categories of no trump, spades, hearts, diamonds, and clubs are each sub-divided into 7 numerical bid levels of 1 to 7. Standard logo art commonly used for the American style deck of playing cards is used to identify the spades, hearts, diamonds and clubs. The different numbers used in these illustrations are random samples to indicate their specific location on the card and their actual size. The top row represents the cards in their ready to be bid outer position. The bottom row represents them in their having been bid inner position. When the bid cards are in their having been bid position, the site of the through holes is considered to be those slightly below the top edge of the card. At all times, once the bid cards are permanently interlocked to the base, the category identity imprints face and read vertically downward to the center point of the base. FIG. 8 depicts the other 5 bid categories. These are pass, double, redouble, skip, and alert. None of these categories are numbered or carry any logo design. They, also, face and read vertically downward to the center point of the base. Their site through holes are also located at the top of each card when it is the having been bid position.

Figure 1:
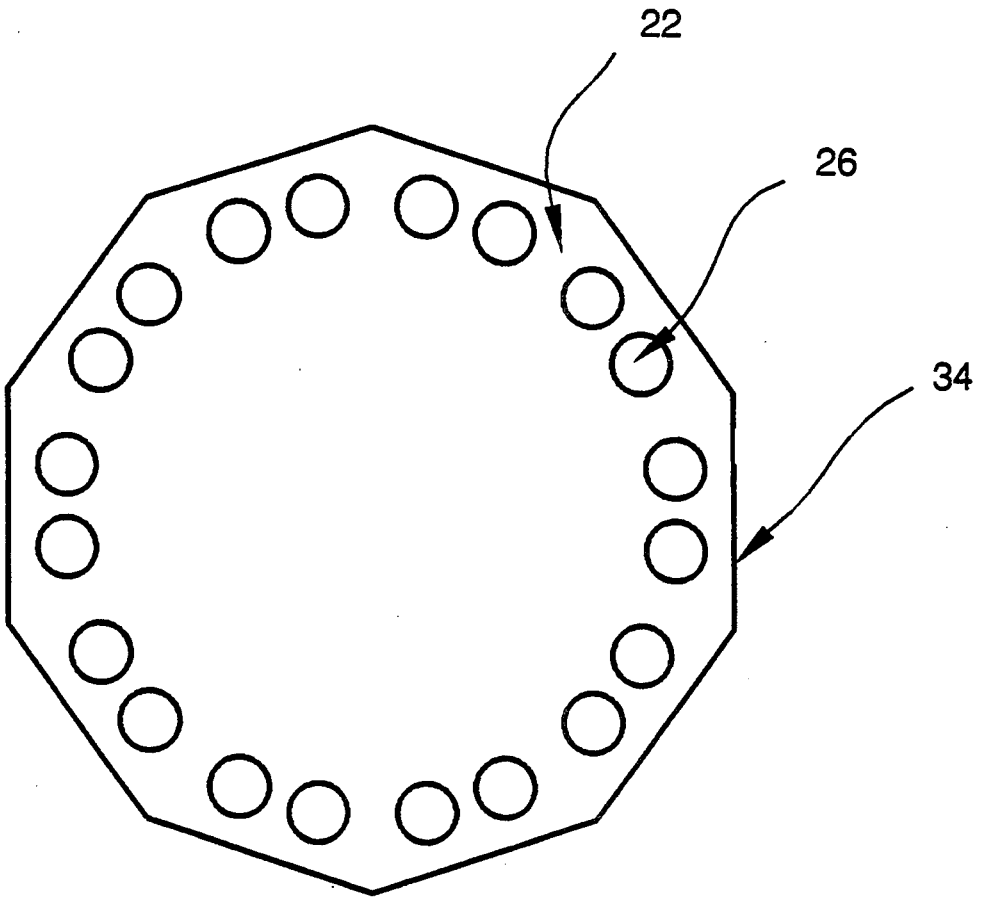
FIG. 1 illustrates the simple straight perimeter edges of the base. It also shows the sites of the 20 spaced through holes; two to each 3.2 cm perimeter edge.

Drawing FIGS. 9A, 9B, 9C, 9D, and 9E relate to the binder comb which is approximately 2.5 cm (1¼") long and 7 mm (½") in diameter.

(a) 9A shows the binder comb in its starting form with its teeth overlapping its spine's exterior.

(b) 9B shows the binder form in its eventual final form with its teeth tucked into the interior of the spine.

(c) 9D shows an open position of the comb with its teeth raised slightly away from its spine. This is a momentary separation, made by hand, to facilitate the insertion of the teeth into the base's through holes through the bottom of the base. Once the teeth are pushed up and passed the through holes emerging out on to the top surface of the base and facing the perimeter edge of the base, the rest of the binder comb spine is fitted around the perimeter edge and engaged with the teeth. The teeth, will of themselves, coil around and overlap the spine as shown in 9C.

Next, to affix the bid cards to the binder comb, the teeth are once again raised away from the spine to allow the bid cards to be slipped on to and become attached to the teeth. When all the cards are attached, the teeth are then tucked under and into the interior of the spine to securely interlock the bid cards and the base as shown by 9B and 9E.

DIMENSIONS-COMPOSITION

The decagon shaped bridge bidder comprises three elements. These are a flat base of ten equal straight sides, a set of 66 bid cards, and 20 plastic binder combs.

(a) The base is of vinyl, or wood, or plastic, or metal. The width of the base is approximately 9.5 cm (3.75"). The base is approximately 3 mm (⅛") thick. Each of the ten outer perimeter sides is 3.2 cm (1¼") wide. The base has two spaced through holes in each of its ten straight sides. The center point of each through hole is 8 mm (5/16") below the perimeter's edge and 11 mm (7/16") in from the left and the right side of the 3.2 cm perimeter ends. Each through hole is 8 mm (5/16") in diameter. These through holes conform to and align with the through holes in the bid cards and to the two teeth of the binder comb. The base itself and its 20 through holes are factory die-cut and drilled. Vinyl is the preferred base material. The inventor is using a vinyl tile manufactured by the Armstrong Company. Each decagon shaped bridge bidder straight side perimeter edge will accomodate one each of the ten different bidding category sets. The base can be expanded to an eleven or twelve equal sided figure to accomodate possible additional bid categories.

(b) The Binder Comb This is a plastic product commercially used to bind booklets, pamphlets and such. It is available at office supply stores. The inventor is using a product manufactured by Ibico, Elkhart, Ill. The binder combs can be purchased in packages of varying sizes and amounts. The inventor is using a comb which is approximately 27 cm (10½") long and 13 mm (½") in diameter. This length is cut into ten 2.5 cm (1") usable units. Each unit consists of a spine and two overlapping teeth. One unit is used for attachment to each of the ten equal perimeter outer sides of the base. Broken down, the 2.5 cm measurement is, from end to end, a lip of 3 mm (3/32"), a tooth of 6 mm (8/32"), a space of 7 mm (10/32"), a tooth of 6 mm (8/32"), and a lip of 3 mm (3/32"). Please see Drawing 6/6 FIGS. 9A and 9B which are enlarged by 100%. The teeth of the 2.5 cm binder comb conform to and align with the through holes in the ten sides of the base and with the through holes in the bid cards. Other means for interlocking the base and bid cards are individual metal binder rings, individual plastic straps, or wire. The binder comb is the preferred form.

(c) The Bid cards The bid cards consist of a custom designed set of 66. Each card is of the same thickness and laminated surface quality as used for the standard American 52 card deck of playing cards. Each card is of the exact same shape and size. Each bid card is approximately 2.5 cm (1") wide and 5.4 cm (2-⅛") long. Each set consists of 7 no trump, 7 spades, 7, hearts, 7 diamonds, 7 clubs, 18 pass cards, 4 double cards, 3 redouble cards, 3 skip cards and 3 alert cards. The first five categories listed are denominated into 7 bidding levels of 1 to 7. Each bid card is similarly imprinted on both its side to identify its category and where pertinent, its numerical bid level denomination. See Drawing 5/6. Each bid card identification is printed vertically on both sides of the card. The imprint faces towards and reads downward to the center point of the base whether the bid cards are in their ready to be bid outer position or in their having been bid inner position. The location site of the two through holes in each bid card is at the top edge of the bid card when it is in its having been bid inner position. The through holes center points are approximately 7 mm (9/32") from the top edge and are approximately 7 mm (9/32") in from both the left and right sides of the long edge of the bid card. The through holes are 8 mm (5/16") in diameter.

The art work for the 66 cards is laid out on a board measuring approximately 32 cm (12-¾")×28 cm (11"). After being printed on both sides, the through holes are made. Then the entire sheet is scored like a sheet of postage stamps so that the cards can be separated.

Assembly of the Decagon Shaped Bridge Bidder

The assembly of the decagon shaped bridge bidder's three elements is done by hand. The three components to be assembled are a base, a set of bid cards, and the binder combs. The shiny surface of the vinyl base is its top side while the dull side is its underbottom.

The base has 20 spaced through holes around its perimeter outer edge consisting of two through holes in each of its ten equal sides. These through holes conform to and align with the through holes in the bid cards and the teeth of the binder comb.

After raising the two teeth from the exterior of the spine of the binder comb, they are inserted, from the underbottom, into and up through the base's two through holes. This insertion is made so that when the teeth emerge out and on to the top surface of the base they are pointing towards the outer perimeter edge of the base. The binder comb spine is then fitted over the outer edge of the base and brought together with the teeth. When the teeth and the spine engage, the teeth, will of themselves, coil around the exterior of the spine. Then once again, by lifting the teeth away from the spine to create enough space, the bid cards are slipped on to the teeth. When all the cards for that particular category are hooked on to the teeth, the teeth are this time fitted under the exterior of the spine and into its interior. This forms a permanent interlock.

When hooking on the bid cards, their imprints must be facing so that they read vertically downward towards the center point of the base.

When hooking on the ten bid categories to each of the ten devices sides, they are arranged in this specific clockwise order, no trump, diamonds, pass, hearts, alert, redouble, clubs, skip, spades, and double.

When the bid cards of the no trump, spades, hearts, diamonds, and clubs, all of which are sub-divided into 7 numerical bid levels of 1 to 7, are attached, they must be affixed with special care. It is imperative that when the cards are in their having been bid inner position in the center point of the base, card number 1 is on the very bottom, then overlapped by card number 2, then 3, 4, 5, 6, 7. When the bid cards are in their ready to bid outer position, bid card number 7 is the bottom card covered by number 6, 5, 4, 3, 2 and 1 is the top card.

How the Decagon Shaped Bridge Bidder Works

Figure 2:
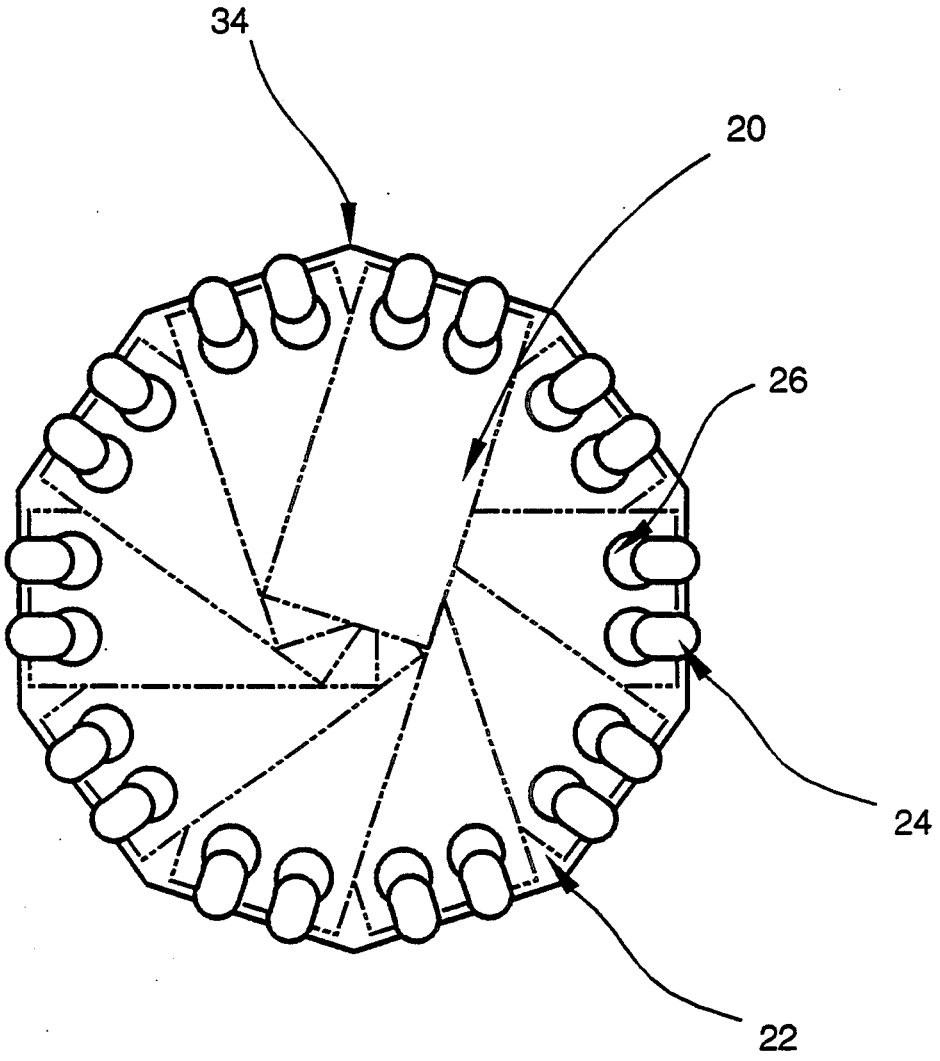
FIGS. 2 and 3 show the device with its bid cards turned into their having been bid inner position in the center point of the base, demonstrating the decagon shaped bridge bidder's doughnut size. In this state, the device measures approximately 10.2 cm (4") wide and 7 mm (½") high. Drawing 3/6
Figure 3:
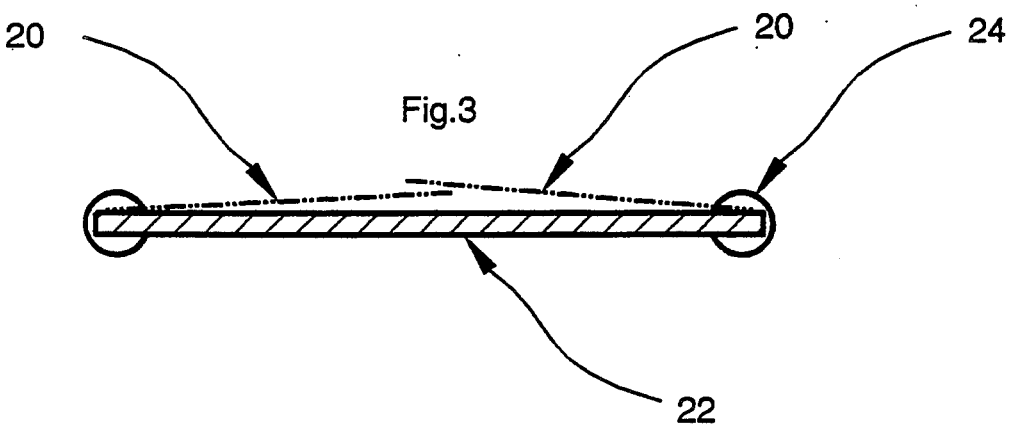
Figure 4:
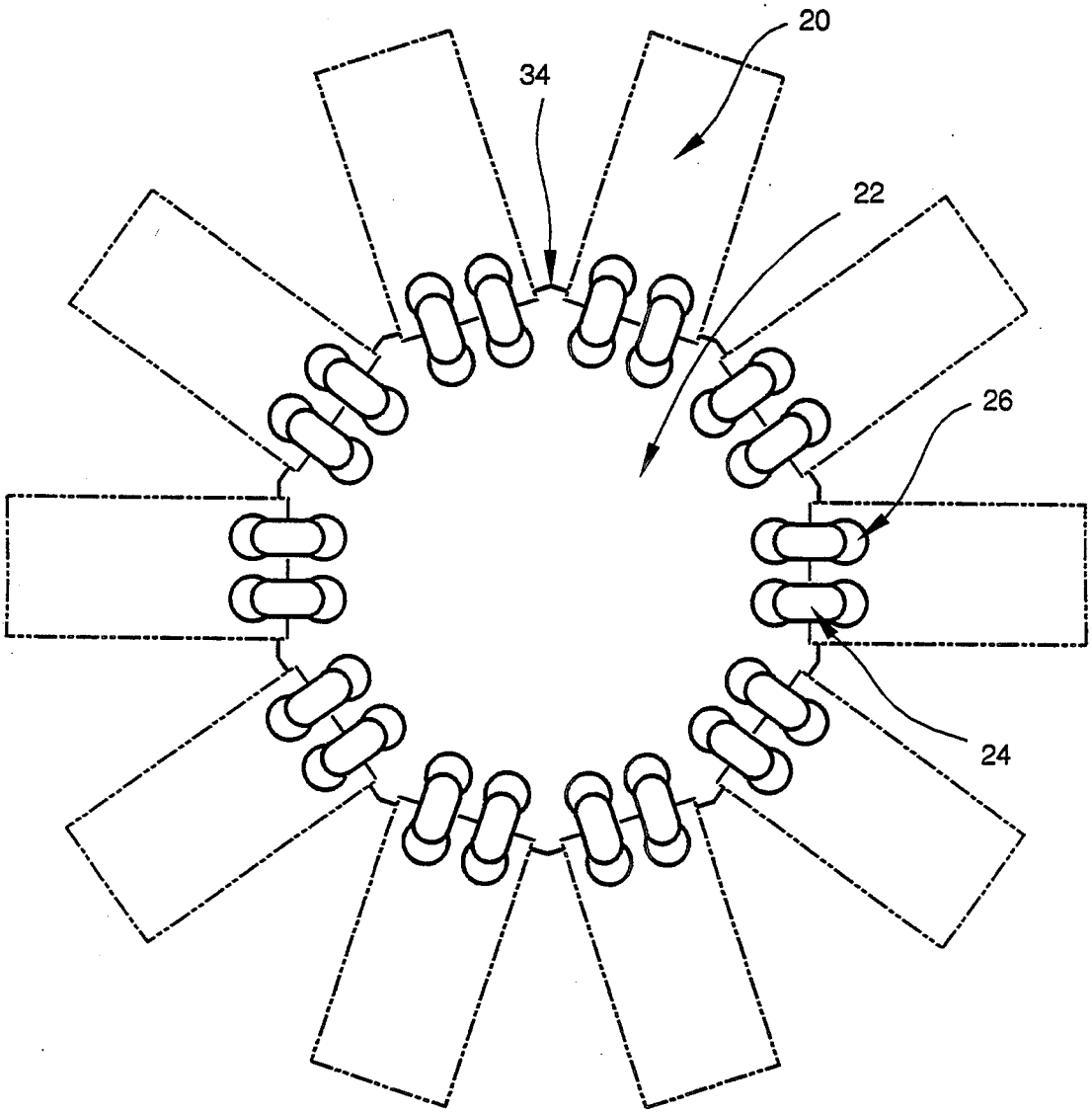
FIGS. 4 and 5 show the device with its bid cards turned outward to their ready to be bid position. In this state the device is approximately 20 cm (8") wide. Drawing 4/6
Figure 5:
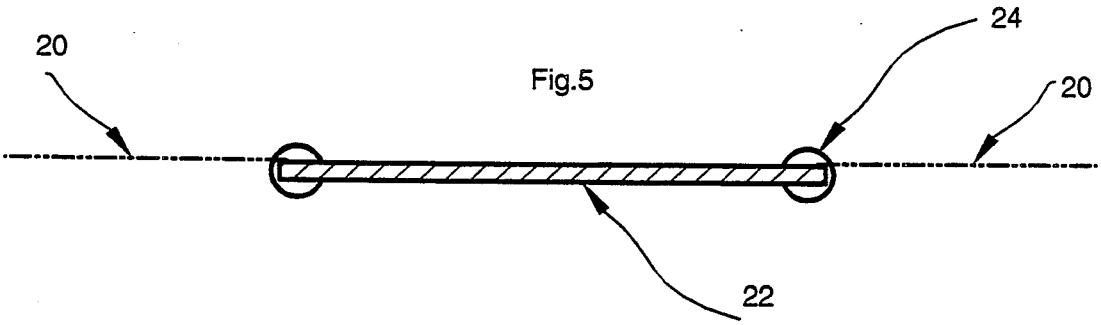
Figure 6:
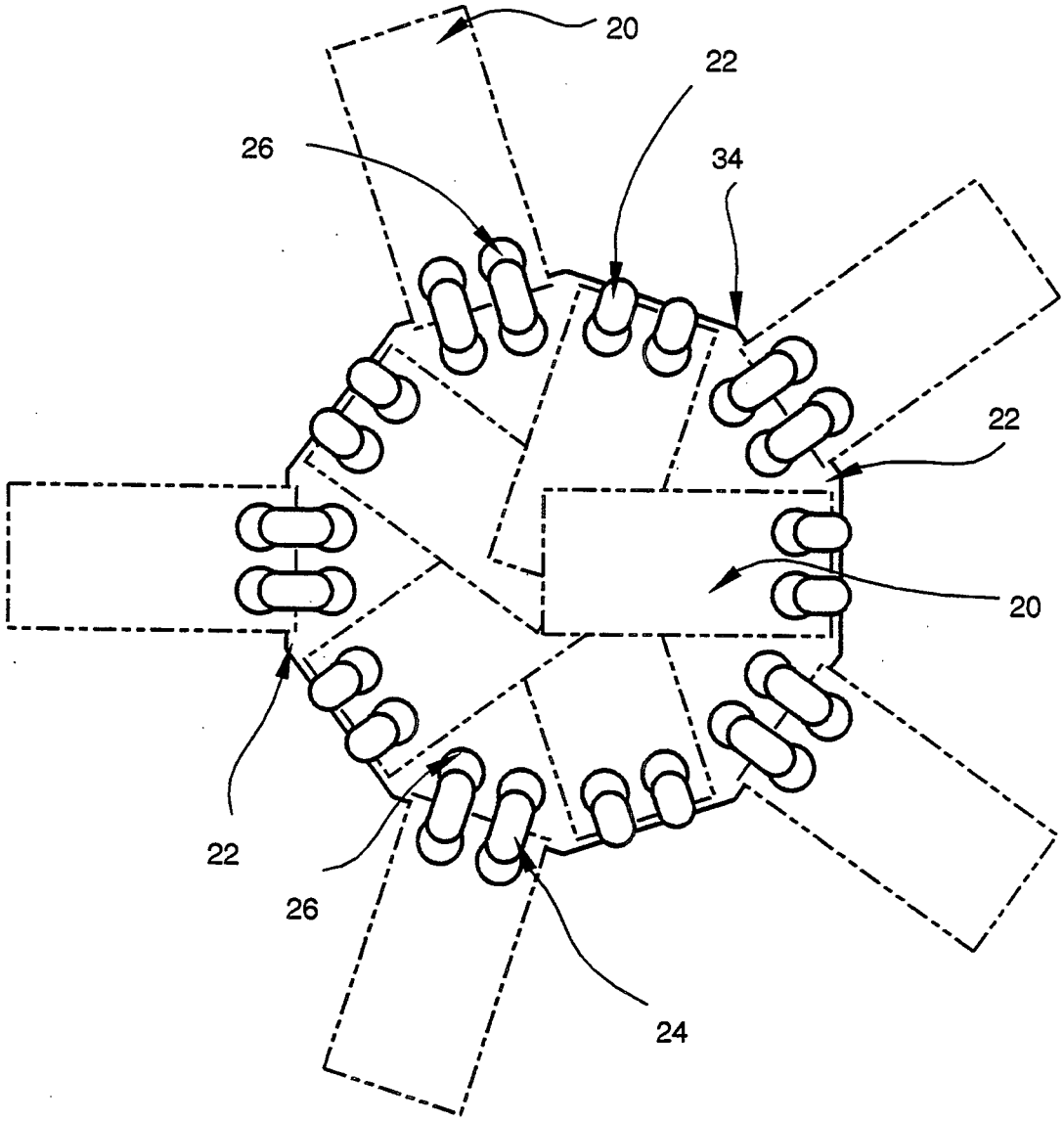
FIG. 6 shows the device with some bit cards in their having been bid inner position and some in their ready to be bid outer position. It also shows how, after each bid is turned into its having bid inner position, it is overlapped by the next bidding card turned inward. This overlapping maintains an accurate record for review purposes. Drawing 5/6
Figure 7:
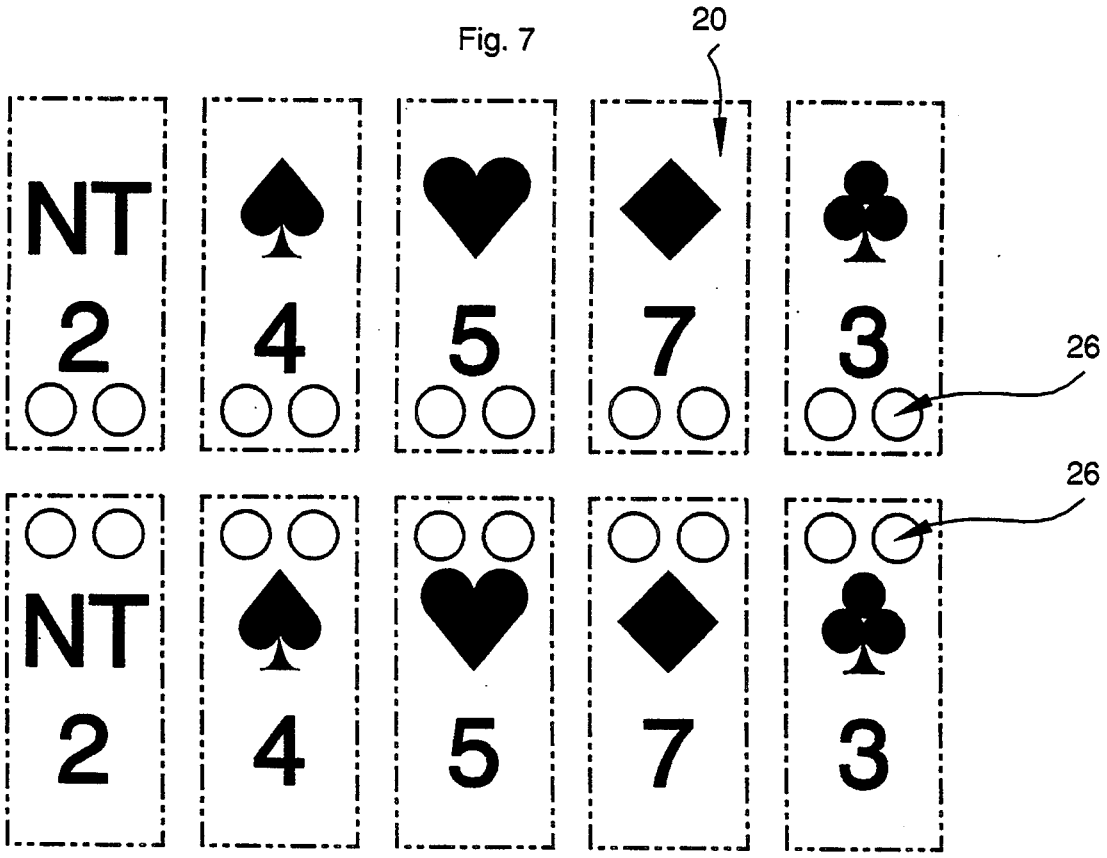
FIGS. 7 and 8 depict the custom designed two-sided bid cards.
Figure 8:
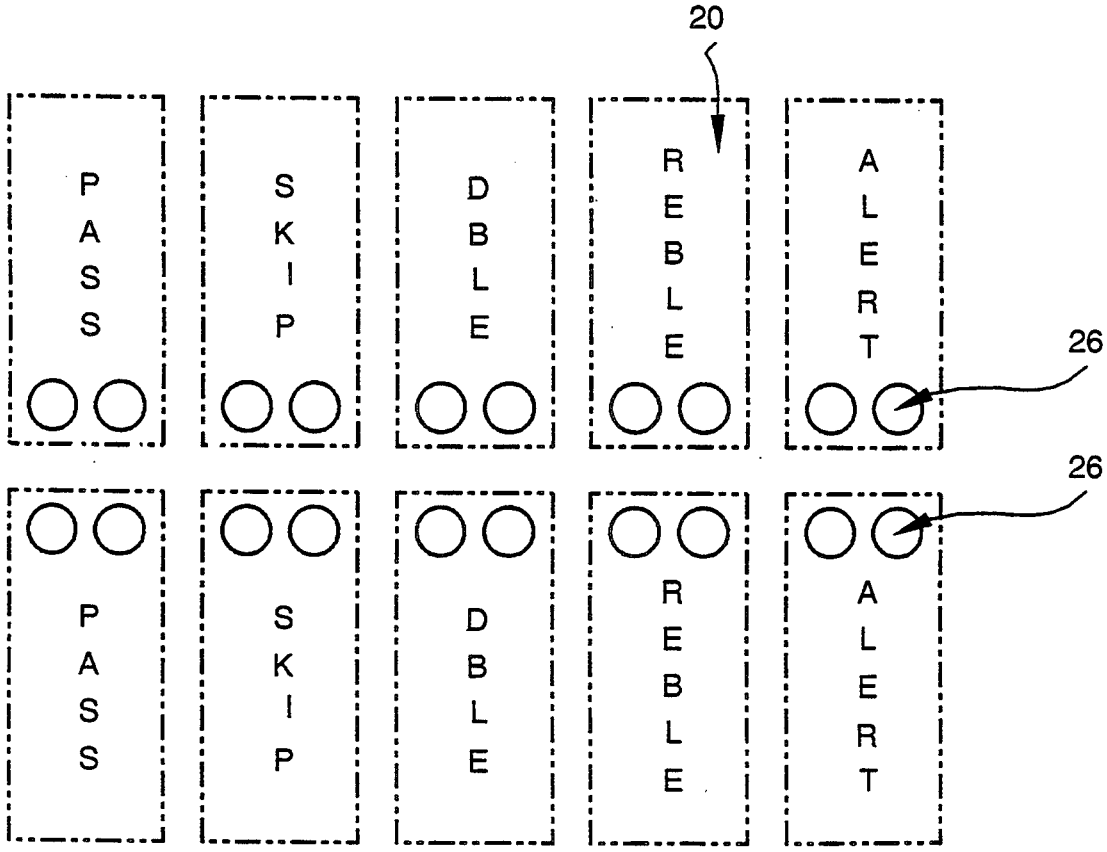
Figure 9A:
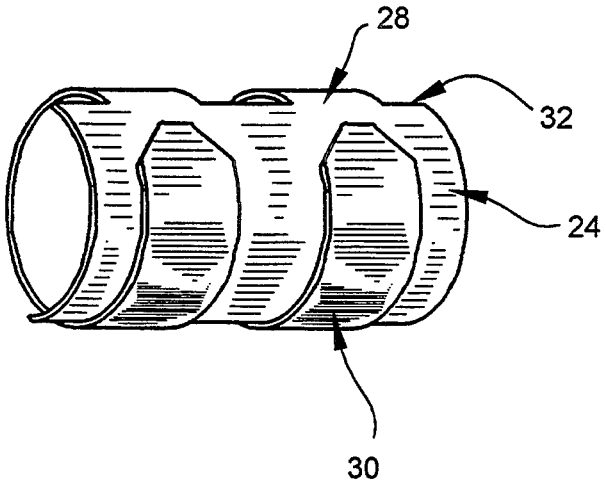
Figure 9B:
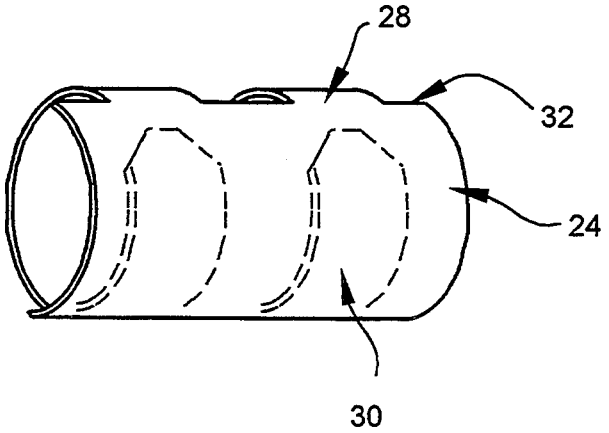
Figure 9C:
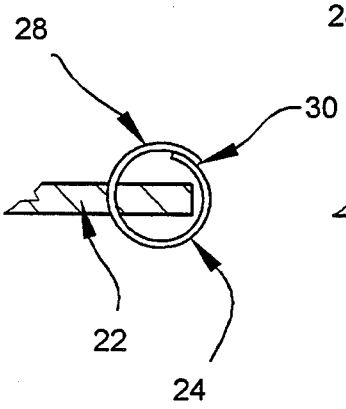
Figure 9D:
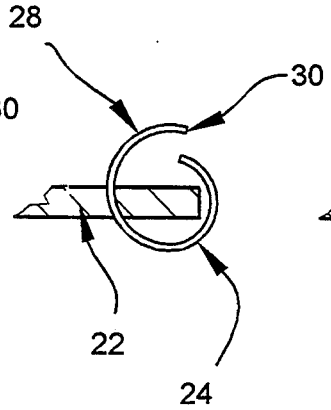
Figure 9E:
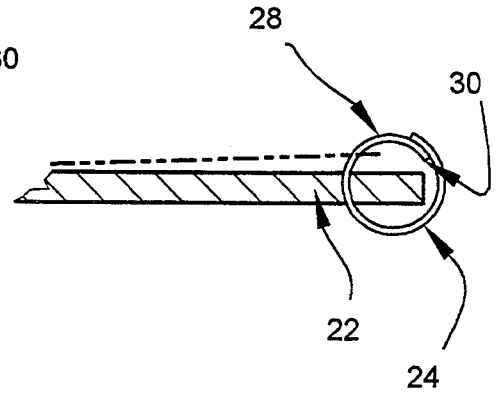

The device is placed on top of and in the center of the table in its closed carrying state. Please see Drawing 2/6 FIG. 2. That is with all its bid cards turned into the center of the base in their having been bid position. There it is readily and handily accessible to and within clear sight of all four players. North sets the device so that the no trump category is directly in front of her/-him. This will accustom the players to the location of the 10 different bid categories. When the players are all ready to bid, the North player turns all the bid cards to their ready to be bid outer position.

The competitive bidding process begins as usual with the designated opening bidder. That player turns his/her selected bid from its ready to be bid outer position to its having been bid inner position at the center point of the base. Then following the established and customary provisions of the game, each player to the opener's left, in sequential order, will select and turn her/his bid in the same manner.

When 3 pass bids have been made in succession, the last competitive bid is the contract won by and to be played by that bidder and his/her partner.

When the bidding process is concluded, those bid cards lying in their having been bid inner position are turned back to their ready to be bid outer position by the South player.

Except for the first card turned into the center, each subsequent bid card, when turned into the having been bid inner area, will overlap some portion of the preceding bid card. This automatic overlapping always shows the last bid and and serves to maintain an accurate record of the sequential order of the bidding for that round and is a reliable review aid.

SUMMARY, RAMIFICATION AND SCOPE

Accordingly, while the decagon shaped bridge bidder addresses and solves the problems of the illegal use of the voice and the improper eavesdropping, it also provides:

@ a visual device which performs as speedily as oral bidding.

@ a visual device which performs accurately.

@ a single apparatus which outperforms the output of four units of the prior art; and which is:

@ exceptionally smaller and lighter than the prior art.

@ easier and more comfortable to use and to carry.

@ is safe-guarded against mis-haps to the bid cards.

@ designed to avoid delays or disruption of the celerity and momentum of the bidding process and thereby the game itself.

While the above description contains many specifications, those should not be construed as limitations on the scope of the invention.

For example: The decagon shaped bridge bidder base is designed to accomodate 10 different legitimate bid categories. Should the addition of other categories be required, the present 10 sided base can be expanded to accomodate such additions.

For example: Varied color schemes and patterns for the bid cards and the base have been designed and will be implemented.

I claim:

1. A decagon shaped bridge bidder comprising a single unit, table top bridge game device used in sequential, clockwise order by all four players during the competitive bidding phase of a bridge game;

said device is intended to enable players to;

(a) bid nonvocally by using custom designed bid cards instead of making verbal announcements;

(b) to be able to bid as fast as the speed of oral bidding;

(c) to be able to use only one said device as opposed to the present market system BIDDING BOXES TM with its compulsory set of 4 boxes per table; any of which box is substantially, by itself, larger and heavier than said decagon shaped bridge bidder;

nonvocal bidding is desired because it eliminates illegal communication between partners using hidden, coded messages by voice changes; it also eliminates the improper practice by contestents who eavesdrop on the oral bidding being made at adjacent tables; the contestents knowing full well that they will shortly be playing the very same hands they are listening in on;

said device comprises 3 elements; said elements are a base, a set of bid cards and binder combs;

said base is a flat decagon shape composed of vinyl, wood, plastic, metal or leather, vinyl is preferred; said base is approximately 9.5 cm (3.75") wide and approximately 3 mm ($\frac{1}{8}$") thick; said base has 10 equal straight perimeter outer edge sides which are each approximately 3.2 cm ($1\frac{1}{4}$") wide; each said 3.2 cm side has two spaced through holes 8 mm (5/16") in diameter; said through holes' center points are approximately 8 mm (5/16") below said perimeter's edge approximately 11 mm (7/16") in from the left and from the right of of said 3.2 cm perimeter's side ends; said through holes conform to and align with through holes in said bid cards and the two teeth of said binder comb; each of said straight perimeter edges will accomodate one of ten different bid categories;

said binder comb is a plastic interlocking component; said binder comb is a one piece unit approximately 2.5 mm (1") long and 13 mm ($\frac{1}{2}$") in diameter so cut from commercially obtained 27 cm (10-$\frac{5}{8}$") binder combs; said binder comb is made up of a spine and said two teeth; said teeth are approximately 6 mm ($\frac{1}{4}$") each in width; said teeth conform to and align with said through holes in said base and said bid cards; said binder comb while interlocking said base with said bid cards also functions as a hinge which enables and facilitates the turning back and forth of said bid cards between their ready to be bid outer position to their having been bid inner position at the center point of the base;

said set of bid cards comprises 66 cards; 7 no trump; 7 spades; 7 hearts; 7 diamonds; 7 clubs; 18 pass; 4 double; 3 redouble; 3 skip; 3 alert; said bid cards are approximately 2.5 cm (1") wide and 5.5 cm (2-$\frac{1}{8}$") long; each said bid card has 2 spaced through holes; said through holes are approximately 8 mm (5/16") in diameter; said through holes are located near the top edge of said bid card when said bid card is in its said having been bid inner position, said through holes' center points are approximately 7 mm (9/32") from said top of said bid card and approximately 7 mm (9/32") in from both the left and from the right sides of same 2.5 cm bid card; said through holes conform to and align with said said through holes of said base and said teeth of said binder comb;

said bid cards are of the same thickness and laminated surface quality as a standard deck of playing cards; said bid cards each have the same imprint on each of its sides; said imprint identifies each category and in the case of no trumps; spades; hearts; diamonds; or clubs includes a numerical denomination designating an individual bid level of one to seven; said imprint identifications read vertically downward from said top of said bid cards towards said center point of said base;

said no trump; spades; hearts; diamonds; and club categories when attached to said teeth of said binder comb must be affixed in such order that when said bid cards are lying in their said having been bid inner position in said center point of said base, card number 1 is on the bottom; covered sequentially by cards numbered 2, 3, 4, 5, 6, 7 on the top; conversely when said bid cards are in said ready to be bid outer position said bid card number 7 is now on the bottom covered sequentially by said bid cards numbered 6, 5, 4, 3, 2, with 1 on the top;

when affixing said 10 categories to said perimeter sides said categories are arranged in a specific clockwise order; said order is said no trump, diamonds, pass, hearts, alert, redouble, clubs, skip, spades, double; when affixing said bid cards said identification imprints must face and read vertically downwards towards said center of said base; assembly of said device is done by hand; said binder comb is attached to said base by slightly raising said teeth of said binder comb away from said binder comb's exterior spine; said teeth are inserted into said through holes from said base's underbottom; said teeth are pushed up and out on to said top surface of said base; when emerging said teeth must be pointing and facing said perimeter outer edge of said base; said binder comb is now fitted over said perimeter edge of said base in the direction of protrusion of said teeth; said spine and said teeth are now fitted together; when said teeth and said spine are fully engaged said teeth will be overlapping said spine's exterior surface;

to affix said bid cards said teeth must once again be raised away from said spine's exterior surface creating enough open space to allow said bid cards to be hooked on to said teeth; said teeth are then fitted under said spine's exterior and into said binder comb's interior forming a secure interlock.

* * * * *